United States Patent [19]

Toth

[11] Patent Number: 4,744,518

[45] Date of Patent: May 17, 1988

[54] FAN ADJUSTMENT FOR PAINT SPRAY GUN

[75] Inventor: Dennis W. Toth, Pontiac, Mich.

[73] Assignee: Can-Am Engineered Products, Inc., Livonia, Mich.

[21] Appl. No.: 929,678

[22] Filed: Nov. 12, 1986

[51] Int. Cl.[4] ..... B05B 1/28

[52] U.S. Cl. ..... 239/297; 239/300

[58] Field of Search ..... 239/296, 297, 290, 300, 239/301, 416, 417, 583

[56] References Cited

U.S. PATENT DOCUMENTS 1,762,282 6/1930 Stephan ..... 239/300

2,204,599 6/1940 Jenkins ..... 239/296

2,470,718 5/1949 Peeps ..... 239/300

2,504,216 4/1950 Morton ..... 239/296

*Primary Examiner*—Andres Kashnikow

*Assistant Examiner*—Karen B. Merritt

*Attorney, Agent, or Firm*—Arnold S. Weintraub

[57] ABSTRACT

A paint spray gun is provided with a means of adjustably controlling fanning of the spray which may be regulated independently of the rotative position of the air cap. A valve member axially shiftable by an adjustment screw adjustably controls the flow of air to fanning control ports in the air cap without interfering with the flow of atomizing air to the paint spray nozzle.

4 Claims, 2 Drawing Sheets

FAN ADJUSTMENT FOR PAINT SPRAY GUN

BACKGROUND OF THE INVENTION

In conventional paint spray guns, a stream of paint under pressure is discharged from a relatively small orifice in a nozzle while air under pressure is discharged radially inwardly into the stream from an annular opening surrounding the nozzle closely adjacent the paint discharge orifice to atomize the stream of paint into a spray of fine particles. The spray thus produced moves away from the gun in an expanding conical pattern whose apex is at the nozzle.

It is frequently desired to modify the circular cross-section of the normal conical spray pattern by transforming this pattern into one of a narrowed and elongated generally elliptically shaped cross-section so that the spray pattern more closely resembles that of a flat sided fan.

In prior art spray guns, fanning of the spray pattern is typically accomplished by providing on the front of the air cap a pair of diametrically opposed ports spaced radially outwardly from opposite sides of the annular air discharge opening and oriented to direct air jets toward opposite sides of the spray pattern at a location spaced a short distance forwardly from the nozzle orifice. These jets have the effect of flattening the sides of the conical spray pattern against which they are directed. At any given distance from the nozzle, this action transforms the normally circular cross-section of the conical spray into a generally elliptically shaped cross-section whose major axis is somewhat greater than the original cone diameter and whose minor axis is somewhat less than the original cone diameter. The "flatness" of the elliptical cross-section will increase with an increase of the pressure at which air is expelled from the diametrically opposed fanning ports.

In prior art guns, adjustment of the fanning of the spray is typically made by rotatively adjusting the air cap. This adjustment exerts a valving action which establishes maximum air flow when the diametrically opposed valve ports lie in either a vertical plane containing the nozzle axis or a horizontal plane containing the nozzle axis. The flow from the fanning parts is reduced as the air cap is rotated to become zero when the fanning ports are midway between the horizontal and vertical positions referred to above. When the fanning ports are at this midway position, the spray assumes its original conical form.

While the foregoing arrangement provides for adjustment to the fanning of the spray, this adjustment is dependent upon the rotated position of the air cap about the nozzle axis. Adjustment of the fan width (minor axis of the elliptical fan cross-section) to a width between maximum or unmodified conical spray and minimum width requires the air cap to have its ports located in a general plane inclined from the vertical. This inclination of the fanning ports establishes the angle the major axis of the elliptical configuration will assume with respect to the vertical, a situation which is inconvenient to the operator who would prefer that this major axis be either vertical or horizontal for all degrees of fanning.

The present invention is directed to a spray gun in which fanning may be adjustably controlled completely independently of the rotative orientation of the air cap.

SUMMARY OF THE INVENTION

In accordance with the present invention, a paint spray gun includes a main housing from which a hollow tubular member projects forwardly. The paint spray nozzle, of conventional construction, is threadably mounted at the forward end of this tubular member whose interior communicates with a fitting in the housing to which a supply of paint under pressure is attached.

A generally cylindrical housing extension is mounted on the housing in coaxial surrounding relationship to the tubular member and an air cap is threadedly attached to the forward end of this tubular extension to define an internal annular air chamber within the extension surrounding the tubular paint carrying member. The air cap is provided with a central air discharge opening through which air is discharged to atomize paint discharged under pressure from the nozzle orifice into a spray.

The rearward or inner side of the air cap is formed with a rearwardly opening counter bore which defines a smooth continuation of the inner side wall of the extension on the housing. The counter bore in the air cap terminates at a radially inwardly projecting shoulder and passages extend through the air cap from diametrically opposed inlets at the juncture of the shoulder and counter bore to diametrically opposed fanning ports oriented to discharge air against opposite sides of the paint spray cone. A cylindrical valve member is slidably received within the counter bore and provided with an annular radial skirt at its forward end which, when seated against the radial shoulder on the air cap will seal the inlet openings of the passages in the air cap which lead to the fanning ports. The skirt defines a central opening through the forward end of the air cylinder which is of a diameter substantially larger than the tubular housing member so that air can pass at all times from the interior of the cylindrical air cylinder to the central air discharge opening of the air cap. A portion of the wall of the cylinder is provided with an opening so that air can pass through a fitting on the housing into the interior of the housing extension and thence through the opening to the interior of the air cylinder. The rearward end of the air cylinder is formed with an opening which is slidably received upon the tubular paint passage member of the housing. A control rod is coupled to the rearward end of the air cylinder and extends rearwardly to the rear end of the housing where it is attached to a manual adjustment member threadably received in the housing. By threading the adjustment member into or out of the housing, the position of the radial skirt of the air cylinder relative to the radial shoulder on the air cap may be varied at will to partially or fully open or close the inlets to the air cap passages leading to the fanning ports.

Other objects and features of the invention will become apparent by reference to the following specification and to the drawings.

IN THE DRAWINGS

Figure 2:
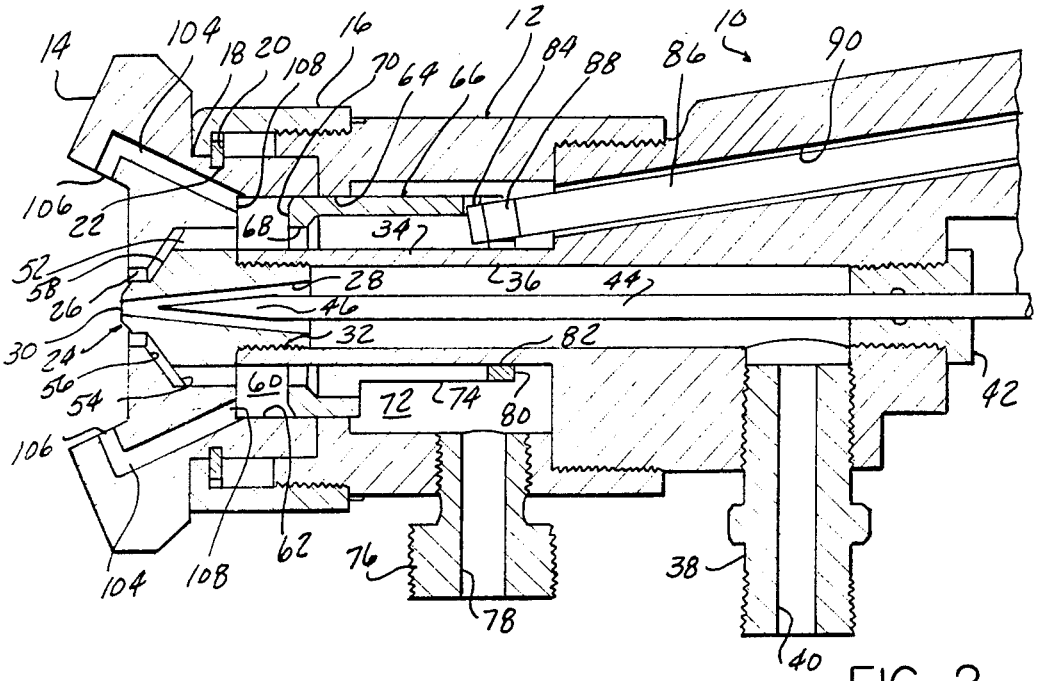
FIG. 2 is a detailed cross-sectional view taken on a central vertical plane through the forward portion of the gun of FIG. 1.
Figure 1:
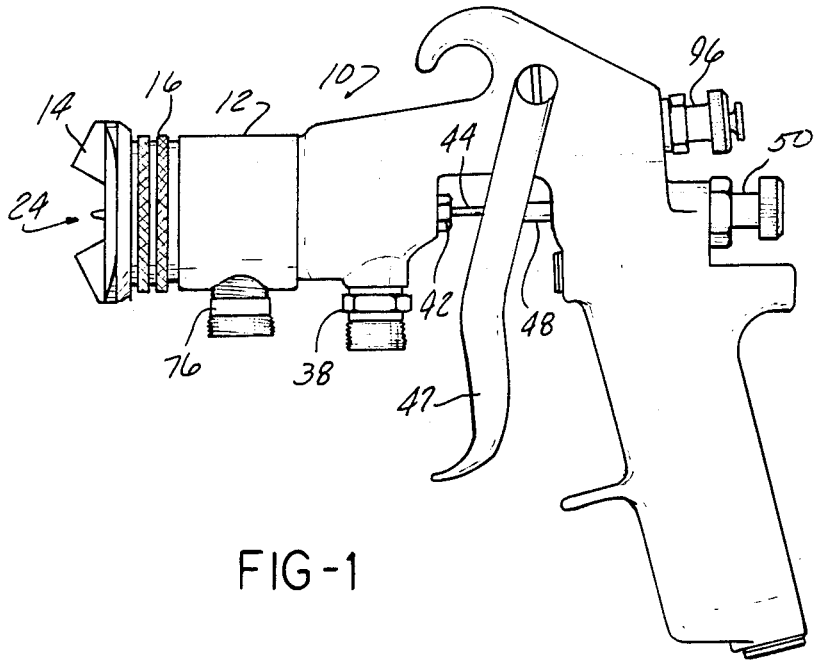
FIG. 1 is a side view of a paint spray gun embodying the present invention.

Referring first to FIGS. 1 and 2, a spray gun embodying the present invention includes a pistol-like main housing designated generally 10 having a generally cylindrical extension 12 fixedly secured to its forward end. An air cap 14 is fixedly mounted on the front end of extension 12 as by an internally threaded annular ring 16 formed at its forward end with a radially inwardly projecting flange 18 (FIG. 2) axially confined to the main body of the cap as by a C ring 20 resiliently seated within a circumferential notch 22. The skirt 16 is freely rotatable relative to the main body of air cap 14. A nozzle 24 projects coaxially through a central opening 26 (FIG. 2) in the forward end of air cap 14.

Nozzle 24 is of conventional construction and, as best seen in FIG. 2, is formed with a forwardly convergent tapered bore 28 which terminates at an orifice 30 at the front end of the nozzle. Nozzle 24 is formed with a threaded shank 32 which is threadably received within the forward end of a forwardly projecting hollow tubular member 34 integrally formed on main housing 10. Paint under pressure is supplied to the central passage 36 which extends through tubular member 34 via a fitting 38 threadably received within housing 10 and having a central passage 40 in communication with passage 36. The rear or right hand end of passage 36 as viewed in FIG. 2 is closed by a threaded plug 42 which also slidably supports and guides an elongate rod-like needle valve 44 having a tapered forward end 46 which may be seated in the conical bore 28 of nozzle 24 to close the orifice 30.

Referring now to FIG. 1, a trigger 47 is pivotally mounted upon housing 10 to engage an enlarged diameter portion 48 formed on needle valve 44 to draw the valve to the right as viewed in FIGS. 1 and 2 when trigger 47 is squeezed. Rod 44 extends rearwardly past the trigger and its enlarged diameter section 48 continues through housing 10 to be coupled to an adjustment knob 50 threadably mounted within the housing.

The coupling between needle valve 44 and adjusting knob 50 is a spring loaded coupling of conventional construction which acts to continuously bias needle valve 44 to the left as viewed in FIGS. 1 and 2 to its closed seated position within nozzle 24. The adjustment knob 50 essentially locates the end limit of movement of the needle valve 44 to the right as viewed in FIGS. 1 and 2 to establish a maximum opening of nozzle 24 when trigger 47 is fully depressed. This arrangement for controlling the flow of paint under pressure from orifice 30 is conventional.

Figure 5:
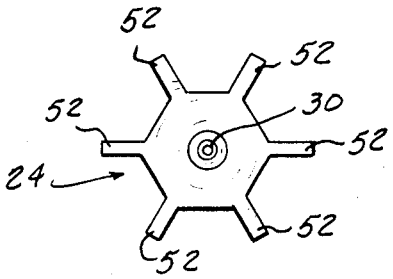
FIG. 5 is a front view of the nozzle of the gun of FIG. 1.

Referring now particularly to FIGS. 2 and 5, from FIG. 5 it is seen that nozzle 24 is formed with a plurality of radially projecting wings 52 whose radially outer ends lie on a cylindrical surface coaxial with the axis of nozzle 24. The rearward side of air cap 14 is formed with a counter bore 54 of a diameter such that the outer ends of wings 52 of the nozzle are slidably received within bore 54. At its inner end, counter bore 54 merges with an inclined conical bore 56 which extends from counter bore 54 to pierce the front side of air cap 14 to establish a discharge opening 26 surrounding the forward tip of nozzle 24. The inclination of the wall of the conical bore 56 and the inclination of the forward side of nozzle 24 as at 58 and the axial dimensions of the air cap and nozzle are such that an air passage is provided, when the nozzle and air cap are assembled in the gun, between discharge opening 26 and a chamber 60 constituted by an enlarged diameter counter bore at the rearward side of air cap 14. This passage extends from opening 26 through space between the opposed inclined surfaces 56 of the air cap and 58 of the nozzle and thence through the spaces between adjacent wings 52 of the nozzle.

Housing extension 12 is formed with a bore 64 in its forward end of the same diameter as the mating counter bore 62 in air cap 14, and bores 62 and 64 slidably receive the forward end of a hollow cylindrical air cylinder 66. Air cylinder 66 is formed with a bore 68 in its forward end wall 70 which is of a diameter larger than the outer diameter of tubular member 34 of the main housing so that chamber 60 within air cap 14 is always in communication with the hollow interior of air cylinder 66. The interior of air cylinder 66 is in turn in constant communication with an air chamber 72 formed within extension 12 via a cutout portion 74 in the air cylinder. Air under pressure may be supplied to chamber 72 via a fitting 76 threaded into extension 12 and having an air supply passage 78.

The rear wall 80 of cylinder 66 is formed with a bore 82 which slidably receives tubular member 34 of main housing 10.

Figure 4:
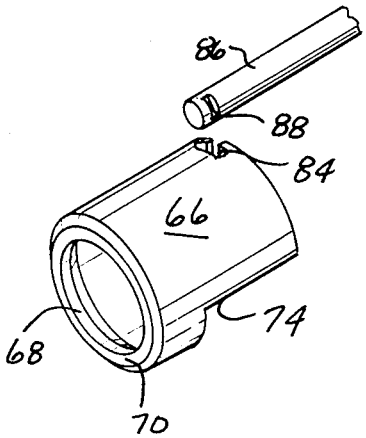
FIG. 4 is a perspective view of the air cylinder and a portion of the control rod of the gun of FIG. 1.

At the upper side of cylinder 66 near its rear wall, a T shaped slot 84 is formed to receive the end of an actuating rod 86. As best seen in FIG. 4, slots 88 are formed in opposite sides of the forward end of rod 86 so that when the end of the rod is seated in T slot 84, the rod and cylinder are coupled to each other for concurrent axial movement in either direction.

Figure 3:
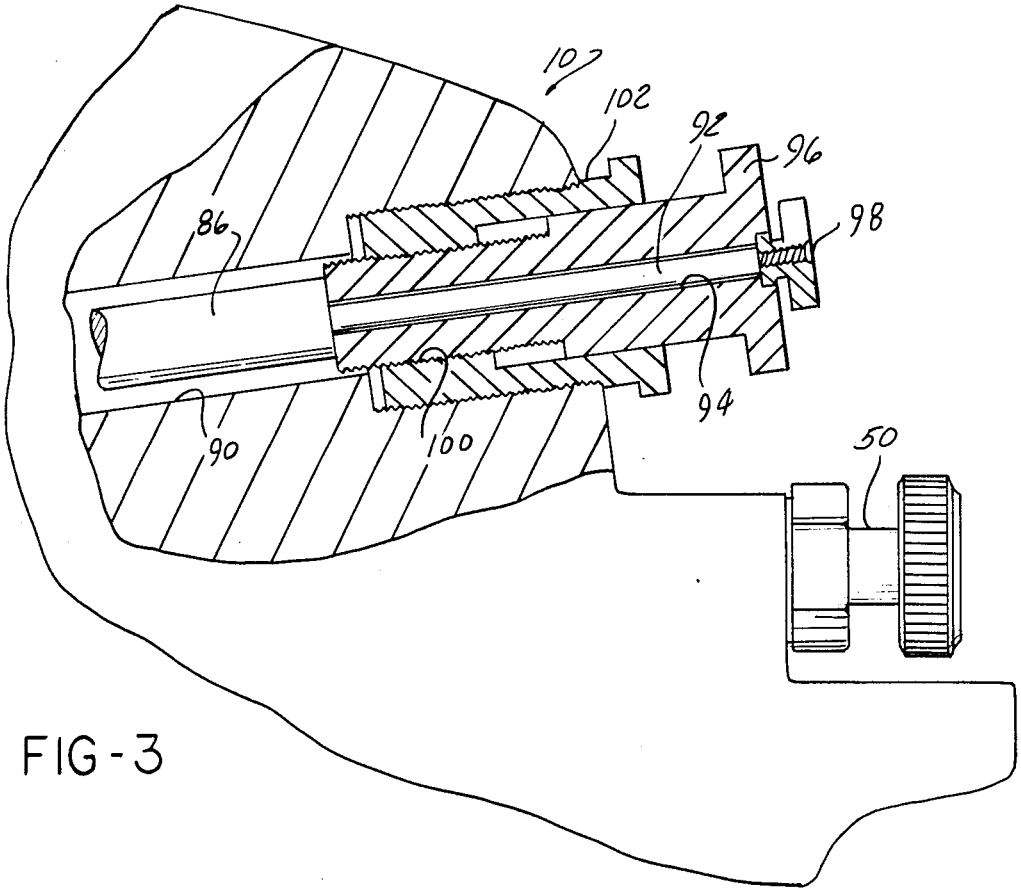
FIG. 3 is a detailed side view of the rearward portion of the gun of FIG. 1, with certain parts broken away or shown in section.

As best seen in FIG. 2, rod 86 extends rearwardly from cylinder 66 through a bore 90 in housing 10. Referring now to FIG. 3, actuating rod 86 is formed with a reduced diameter end section 92 at its rearward end which passes rearwardly through a bore 94 in an adjustment screw 96. A knurled nut 98 threadably received on the end of portion 92 of actuating rod 86 axially fixes rod 86 to adjustment screw 96 while accommodating rotary movement of screw 96 relative to rod 86. Rod 86 is restrained against rotary movement by the engagement between the slots 88 (FIG. 4) in the forward end of rod 86 and the walls of the T slot 84.

Adjustment screw 96 is threadably received as at 100 within a fitting 102 threadably locked to housing 10. Threading of adjustment screw 96 into or out of fitting 102 is transmitted by actuating rod 86 to air cylinder 66 to axially shift air cylinder 66 relative to air cap 14.

Returning now to FIG. 2, a pair of fan control passages 104 are formed through air cap 14 to extend from chamber 60 in the air cap to inwardly inclined air discharge ports 106.

In FIG. 2, air cylinder 66 is shown at its maximum opened position in which air under pressure flowing into chamber 60 from fitting 76 can pass freely both to the central opening 26 of air cap 14 to atomize a paint stream issuing under pressure from nozzle 30 and also freely through passages 104 to be discharged from ports 106 against opposite sides of the conical spray of paint issuring from nozzle 24. It is believed apparent that as air cylinder 66 is moved to the left from its FIG. 2 position by manipulation of adjustment knob 96, the front wall 70 of air cylinder 66 will be advanced toward the inlet openings 108 of passages 104 and as the front wall 70 of cylinder 66 moves into contact with the radial shoulder between counter bores 62 and 54 in the nozzle, these inlet openings will be progressively blocked and eventually sealed by forward wall 70. By adjustably positioning forward wall 70 of air cylinder 66, a variable restriction to the flow of air through passages 104 and the fanning ports 106 is available. This control of the fanning is independent of the rotative position of air cap 14 about the nozzle axis.

While one embodiment of the invention has been described in detail, it will be apparent to those skilled in the art the disclosed embodiment may be modified. Therefore, the foregoing description is to be considered exemplary rather than limiting, and the true scope of the invention is that defined in the following claims.

What is claimed is:

1. In a paint spray gun including a housing, an annular air cap mounted at the forward end of said housing, said air cap having a central air discharge opening extending coaxially therethrough, nozzle means mounted on said housing coaxially of said air discharge opening, said nozzle means having a paint discharge orifice at its forward end for discharging paint under pressure in a forwardly directed stream coaxially of said air discharge opening, first passage means in said housing for supplying paint under pressure to said discharge orifice, second passage means in said housing for supplying air under pressure to said air discharge opening to atomize paint discharged from said orifice into a spray, and third passage means in said air cap communicating with said second passage means for discharging air from diametrically opposed parts in said air cap to control fanning of said spray;

the improvement comprising valve means in said housing adjustably movable between a fully open and a fully closed position for adjusting the flow of air from said second passage means to said third passage means, the atomizing air and fanning air being discharged from a single chamber formed in the air cap forward of the valve means prior to discharge into said second and third passages, respectively, and manually operable means independent of said air cap for adjustably positioning said valve means.

2. The invention defined in claim 1 wherein said first passage means comprises a hollow tubular member fixedly secured to and extending coaxially rearwardly from said nozzle means, and said second passage means comprises means defining an annular air chamber coaxially surrounding said tubular member, said air chamber having a pair of outlet openings defining inlets to said third passage means, and said valve means comprises an annular valve member slidably mounted for axial movement within said air chamber.

3. The invention defined in claim 2 wherein said air cap has a rearwardly opening bore in its rearward side coaxial its discharge opening terminately at its inner end at a rearwardly facing radial shoulder, the wall of said bore and said shoulder defining portions of the outer side and front end walls of said annular air chamber, said outlet openings being located at the juncture of said bore and shoulder, said annular valve member including an outer wall slidably received within said bore, an annular front wall on said valve member projecting radially inwardly from said outer wall at the front end thereof engageable with said shoulder on said air cap when said valve means is in said closed position to cover said outlet openings, said front wall having a central opening therethrough of a diameter greater than the outer diameter of said tubular member, and means at the rearward end of said valve member slidably received upon said tubular member.

4. The invention defined in either claim 2 or claim 3 wherein said manually operable means comprises a rod coupled at one end to said valve member, and means adjustably threaded into said housing coupled to the opposite end of said rod for shifting said rod relative to said housing in a direction generally axially of said annular air chamber.

* * * * *